US011655974B2

(12) United States Patent
Chavan et al.

(10) Patent No.: US 11,655,974 B2
(45) Date of Patent: May 23, 2023

(54) COMPOSITE FIN HEAT SINK

(71) Applicant: Eaton Intelligent Power Limited, Dublin (IE)

(72) Inventors: Poonam Chavan, Karad (IN); Anzar Pandurang Rade, Pune (IN); Ajay Chidambaram Pillai Swornalatha, Nagercoil (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/805,705

(22) Filed: Jun. 7, 2022

(65) Prior Publication Data

US 2022/0397265 A1 Dec. 15, 2022

(30) Foreign Application Priority Data

Jun. 11, 2021 (IN) ..... 202111026040

(51) Int. Cl.
*F21V 29/76* (2015.01)
*F21V 29/89* (2015.01)
*F21V 29/80* (2015.01)

(52) U.S. Cl.
CPC ..... *F21V 29/76* (2015.01); *F21V 29/80* (2015.01); *F21V 29/89* (2015.01)

(58) Field of Classification Search
CPC ..... F21V 29/76; F21V 29/80; F21V 29/89
See application file for complete search history.

(56) References Cited

U.S. PATENT DOCUMENTS

| | | | | |
|---|---|---|---|---|
| 2,595,457 | A | 5/1952 | Holm | |
| 2004/0150956 | A1 | 8/2004 | Conte | |
| 2008/0080162 | A1* | 4/2008 | Wilcox | F21V 29/763 362/20 |
| 2008/0084701 | A1* | 4/2008 | Van De Ven | F21V 17/164 362/373 |
| 2010/0110636 | A1* | 5/2010 | Chou | F21V 29/763 361/702 |
| 2012/0250333 | A1* | 10/2012 | Chou | H01L 23/42 362/382 |
| 2013/0088882 | A1* | 4/2013 | Guercio | F21V 29/507 362/373 |
| 2016/0223183 | A1* | 8/2016 | Zou | F21V 29/67 |
| 2018/0003370 | A1* | 1/2018 | Mandlekar | F21V 15/01 |

* cited by examiner

*Primary Examiner* — Bryon T Gyllstrom
(74) *Attorney, Agent, or Firm* — Pearne & Gordon LLP

(57) ABSTRACT

A light device including a housing having at least one wall that defines an internal cavity. A heat sink is attached to the housing. The heat sink includes a body, a plurality of mat fins disposed about a periphery of a body, and a plurality of pin fins disposed in staggered rows on a central portion of a face of the body. The plurality of mat fins direct air in a predetermined direction to the central portion and the plurality of pin fins define a plurality of tortuous air paths along the central portion.

13 Claims, 5 Drawing Sheets

COMPOSITE FIN HEAT SINK

FIELD OF THE INVENTION

The present invention relates to a heat sink for a light device, and more particularly, to a composite fin heat sink for use with a light device.

BACKGROUND OF THE INVENTION

Light systems may be used in many different types of environments, including hazardous environments, to provide proper illumination to workers. The light systems are required to comply with a number of standards and regulations to ensure safety when operating equipment.

Because of the conditions of the environment, i.e., excessive heat, dirt, water, chemicals, etc. it is critical that the light system be maintained below a critical temperature. Conventional light systems use fin heat exchangers to dissipate heat from the light system.

There is a need for a heat sink with increased efficiency and less material cost.

SUMMARY OF THE INVENTION

A light device including a housing having at least one wall that defines an internal cavity. A heat sink is attached to the housing. The heat sink includes a body, a plurality of mat fins disposed about a periphery of a body, and a plurality of pin fins disposed in staggered rows on a central portion of a face of the body. The plurality of mat fins direct air in a predetermined direction to the central portion and the plurality of pin fins define a plurality of tortuous air paths along the central portion.

DETAILED DESCRIPTION OF PREFERRED EMBODIMENTS

Figure 1B:
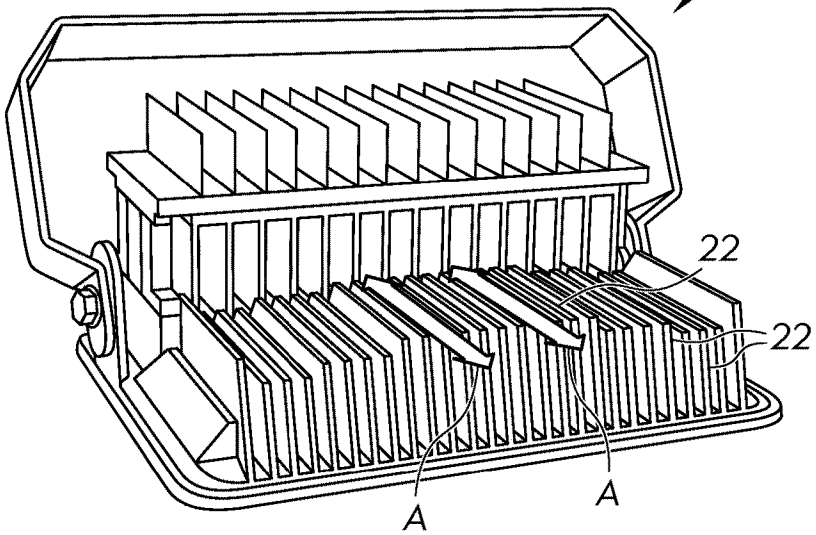
FIG. 1B (PRIOR ART)
FIG. 1B is a perspective view of a heat sink of the conventional light assembly of FIG. 1.
Figure 1A:
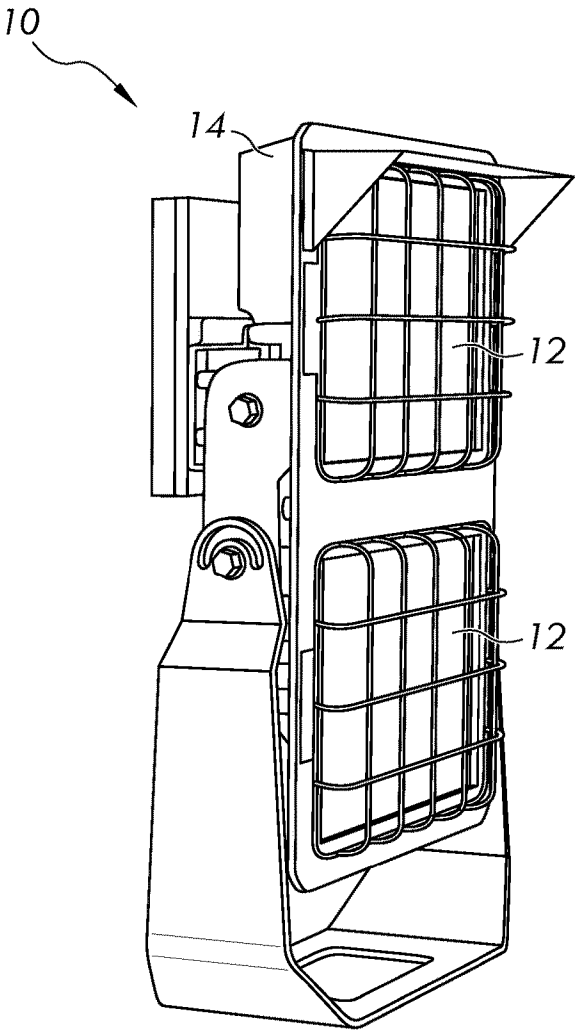
FIG. 1A (PRIOR ART)
FIG. 1A is a front, perspective view of a conventional light assembly.

Referring now to the drawings, FIG. 1 shows a front perspective view of a conventional light assembly 10 for use in a hazardous environment. Example hazardous environments include, but are not limited to an airplane hangar, a drilling rig (as for oil, gas, or water), a production rig (as for oil or gas), a refinery, a chemical plant, a power plant, a mining operation, a wastewater treatment facility, and a steel mill. A user may be any person that interacts with example light systems in hazardous environments. Examples of a user may include, but are not limited to, an engineer, an electrician, an instrumentation and controls technician, a mechanic, an operator, a consultant, a contractor, and a manufacturer's representative. Although the light assembly 10 is described in relation to use of the light assembly 10 in a hazardous environment, the light assembly 10 is not limited to use in such environments.

The light assembly 10 includes one or more light sources 12 and a conventional heat sink 20 (FIG. 1B) attached to a rear of the light source 12. The light source 12 may be configured to provide light at a predetermined intensity. In this respect, the light source 12 may provide light at a single intensity or a variable intensity, as needed.

The light source 12 includes a housing 14. The housing 14 can be made of one or more of a number of suitable materials to allow the light assembly 10 to meet certain standards and/or regulations while also maintaining durability in light of the one or more conditions under which the light assembly 10 can be exposed. Examples of such materials can include, but are not limited to, aluminum, stainless steel, fiberglass, glass, plastic, ceramic, and rubber.

It is contemplated that the light assembly 10 may be subject to meeting certain standards and/or requirements. For example, the National Electric Code (NEC), the National Electrical Manufacturers Association (NEMA), Underwriters Laboratories (UL), the International Electrotechnical Commission (IEC), and the Institute of Electrical and Electronics Engineers (IEEE) set standards as to electrical enclosures, wiring, and electrical connections. As used herein, the term "intrinsically safe" refers to a device (e.g., an example light assembly 10 herein) that is placed in a hazardous environment. To be intrinsically safe, the device uses a limited amount of electrical energy so that sparks cannot occur from a short circuit or failures that can cause an explosive atmosphere found in hazardous environments to ignite.

The light assembly 10 includes a conventional fin plate heat sink 20 (FIG. 1B). The fin plate heat sink 20 is configured to have a predetermined heat transfer rate. Referring to FIG. 1B, the fin plate heat sink 20 includes a plurality of parallel fins 22 that are positioned on an outer surface of the heat sink 20. The parallel fins 22 define straight air pathways "A" from one side of the heat sink 20 to an opposite side of the heat sink 20.

Figure 2:
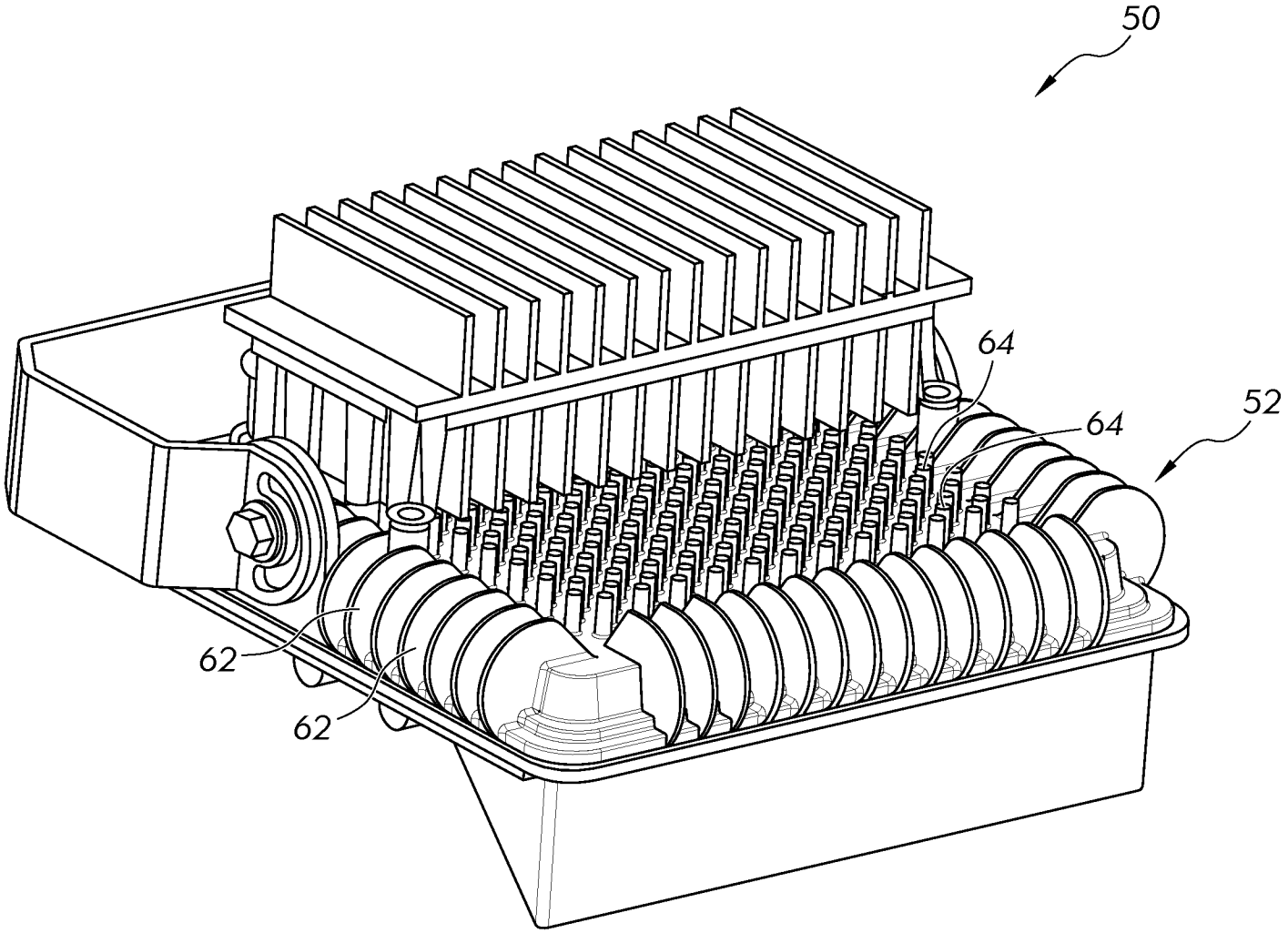
FIG. 2 is a perspective view of a heat sink according to the present invention.
Figure 3:
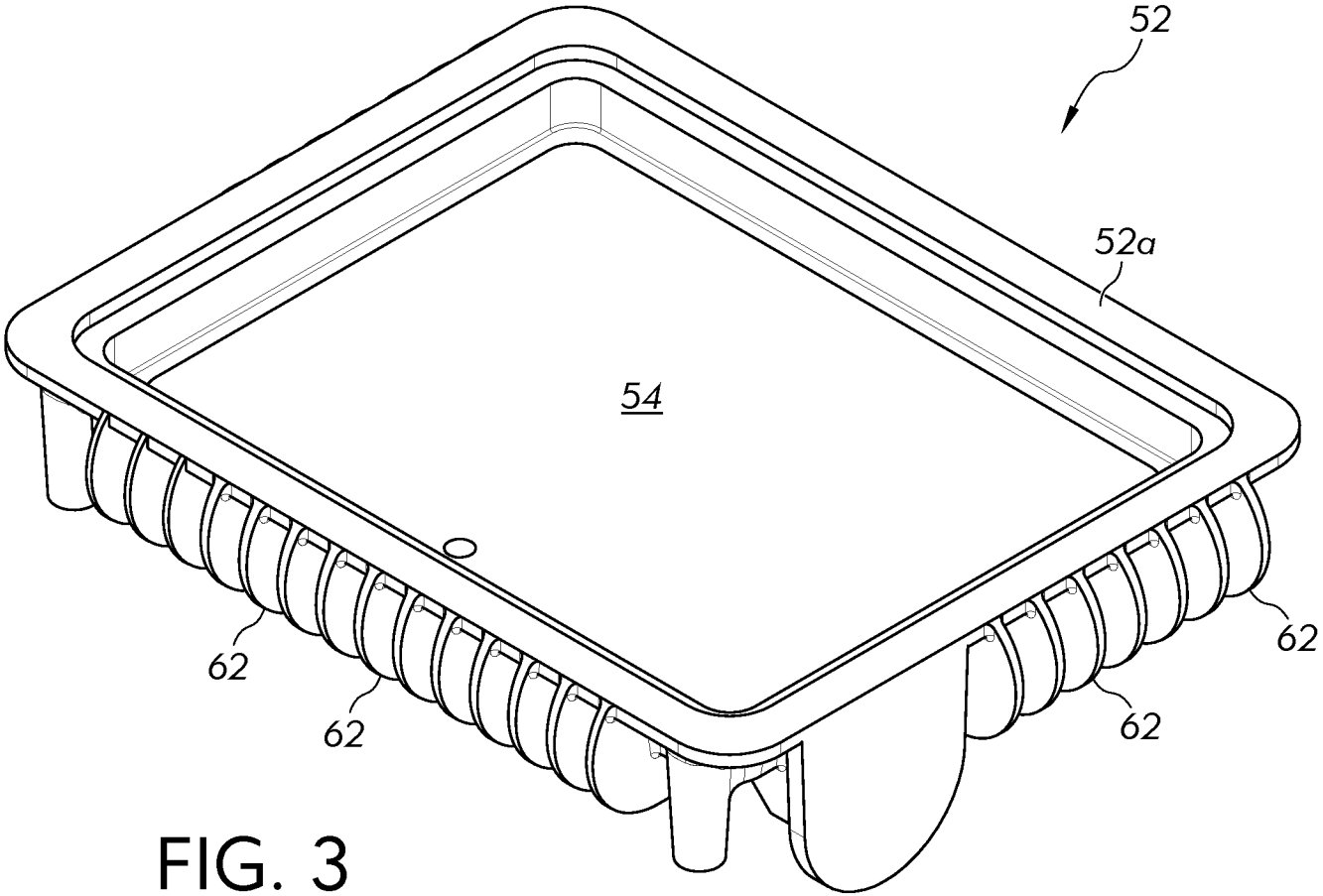
FIG. 3 is a rear perspective view of the heat sink of FIG. 2.

Referring to FIG. 2, a heat sink 50, according to the present invention is illustrated. The heat sink 50 includes a cast body 52 that is provided for transferring heat to a surrounding environment. Referring to FIG. 3, the cast body 52 has a recessed cavity 54 formed in a rear surface 52*a* of the body 52. The body 52 may be made from cast aluminum. The recessed cavity 54 may be sized to received heat producing components (not shown) of the light source 12. In this respect, the heat producing components (not shown) are in close proximity to the body 52 to provide for efficient heat transfer from the heat producing components (not shown) to the body 52.

The recessed cavity 54 may have any of a number of configurations to house the heat producing components (not shown). Although the recessed cavity 54 is illustrated as having a flat bottom, it is contemplated that the recessed cavity 54 may have other shapes and/or features to aid in the efficient transfer of heat from the heat producing components (not shown) to the cast body 52.

Figure 4:
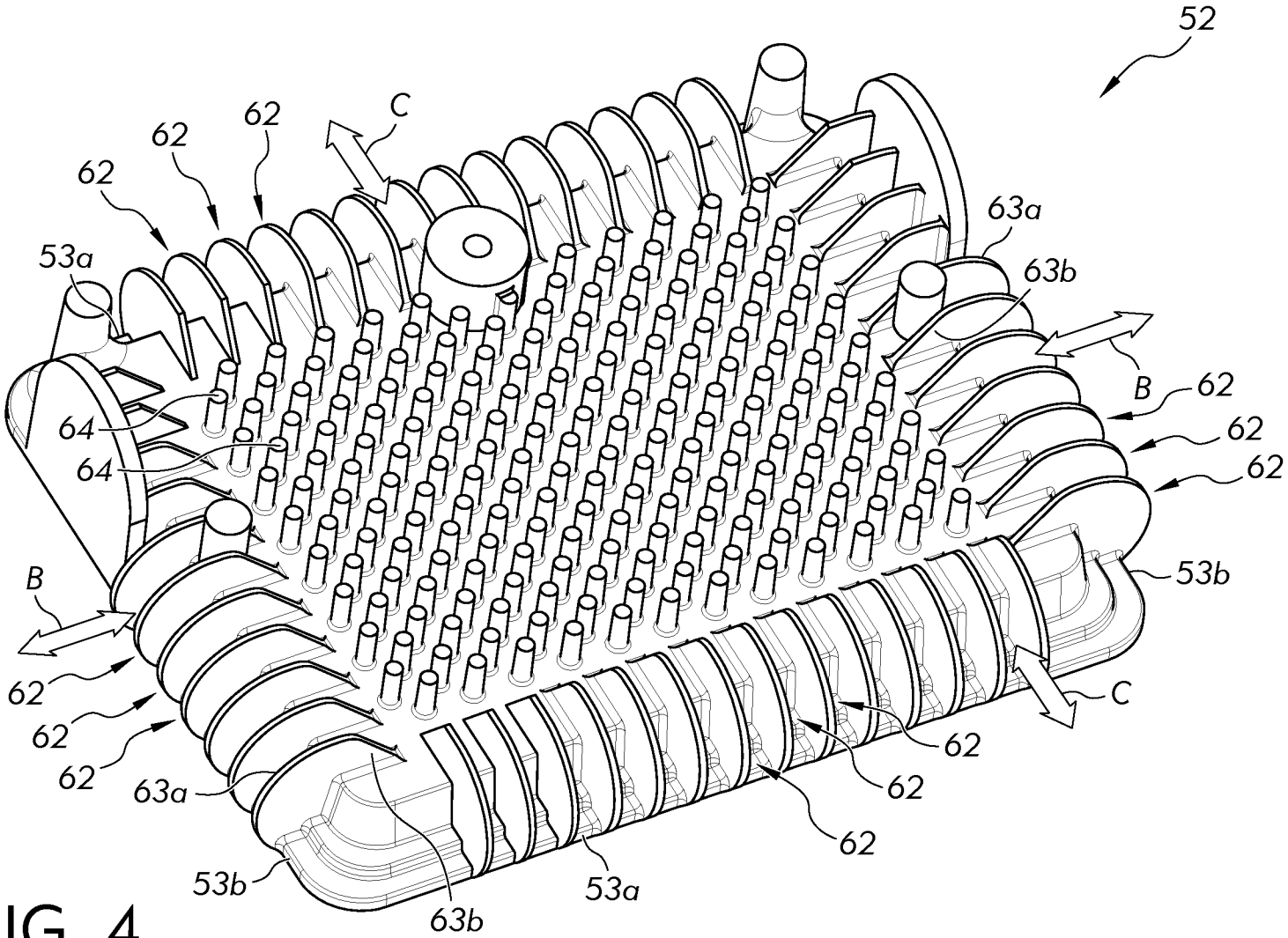
FIG. 4 is a front perspective view of the heat sink of FIG. 2.

Referring to FIG. 4, a plurality of mat fins 62 are disposed about a periphery of the body 52. The mat fins 62 along each side are oriented to be parallel with other mat fins 62 along the same side. In this respect, air passing between adjacent mat fins 62 is directed toward a center of the body 52, i.e., along flow paths "B" and "C". In the illustrated embodiment, fourteen mat fins 62 are disposed along opposite long sides 53*a* of the body 52 and seven full mat fins 62 and four shortened mat fins 62 are disposed along opposite short sides

53*b* of the body 52. Although the body 52 is illustrated with the fourteen and eleven fins on opposite sides 53*a*, 53*b*, it is contemplated that the body 52 may include any number of mat fins 62 along the edges of the body 52. In the embodiment illustrated, the mat fins 62 are planar-in-shape with a curved outer edge portion 63*a* that transitions into an angled or sloped portion 63*b*. It is contemplated that the mat fins 62 may have other shapes, for example, but not limited to, curved, sloped, etc. or any combination of the foregoing. It is also contemplated that the outer edge of the mat fins 62 may have other shapes, for example, but not limited to, straight, sloped, saw-toothed, wavey, etc. or any combination of the foregoing. In the embodiment illustrated, each of the mat fins 62 has an identical height, i.e., as measured from a base of the mat fin 62 to a distal edge of the mat fin 62. It is contemplated that the mat fins 62 may have different heights.

Figure 5:
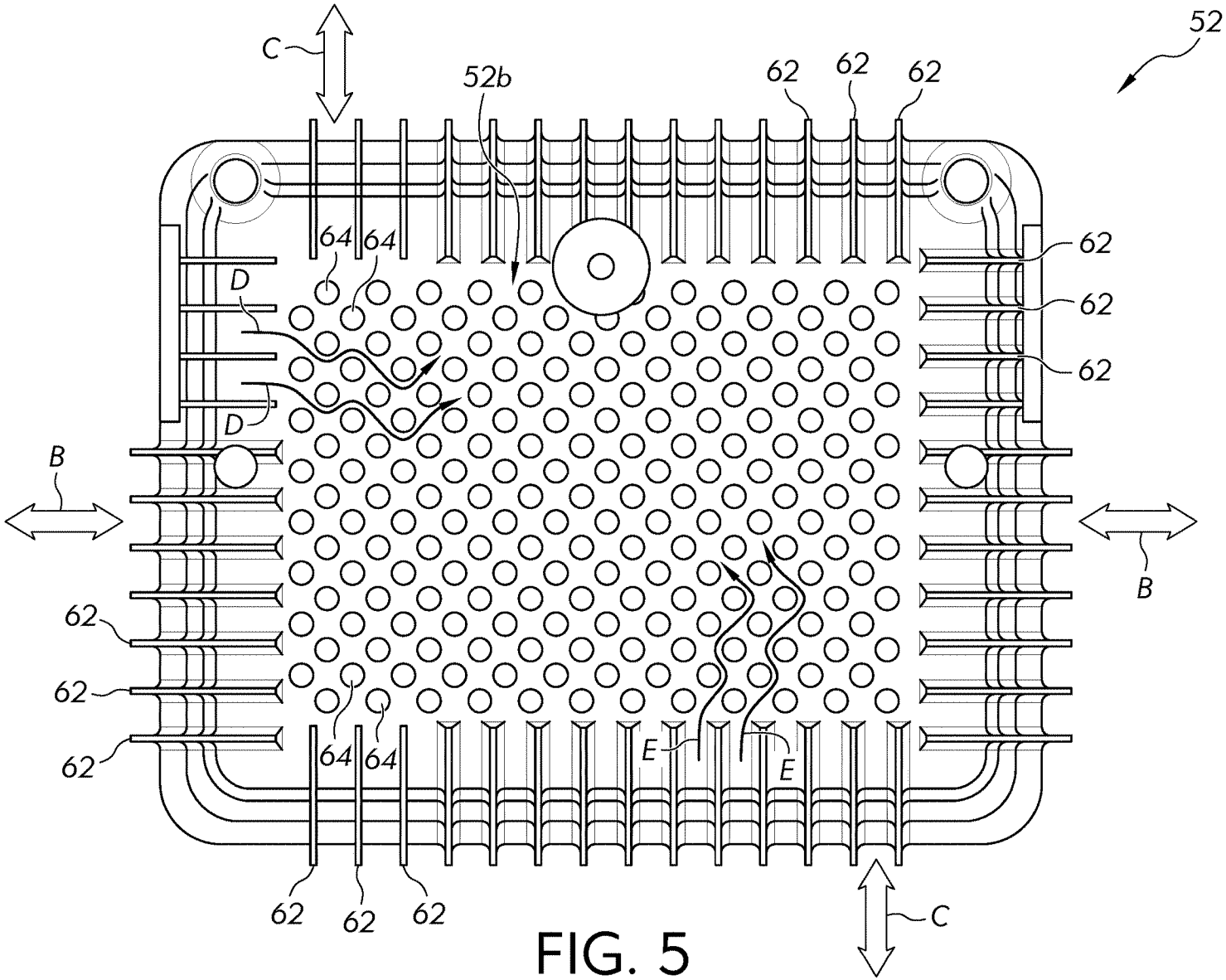
FIG. 5 is a top view of the heat sink of FIG. 2.

Referring to FIG. 5, a plurality of pin fins 64 are positioned in a central portion 52*b* of the body 52. The pin fins 64 are illustrated arranged in a staggered matrix arrangement wherein the pin fins 64 in one row or column are shifted or offset relative pin fins 64 in adjacent rows or columns. This arrangement of pin fins 64 creates a meandering flow path for air flowing from one side of the body 52 to the opposite side of the body 52, see flow paths "D" and "E" in FIG. 5. The meandering flow paths "D" and "E" are configured to improve the heat transfer characteristics of the body 52. In the embodiment illustrated, the pin fins 64 are cylindrical-in-shape. It is contemplated that the pin fins 64 may have other shapes, for example, but not limited to, triangular, elliptical, rectangular, prismatic, etc. In the embodiment illustrated, each of the pin fins 64 has an identical height, i.e., as measured from a base of the pin fin 64 to a distal tip of the pin fin 64. It is contemplated that the pin fins 64 may have different heights.

The present invention will now be described relative to the operation of the same. During use, heat from the heat producing components (not shown) of the light source 12 generate heat that is transferred to the heat sink 50. The heat generated is then conducted to the mat fins 62 and the pin fins 64. The surrounding environmental air is caused to flow, via natural convection over the front face of the body 52. In particular, the mat fins 62 direct the air flow toward the central portion 52*b* of the body 52, i.e., along flow paths "B" and "C" (FIGS. 4 and 5). Thereafter, the air flows along the central portion 52*b* of the body 52 along flow paths "D" and "E".

The positioning and configuration of the mat fins 62 and the pin fins 64 are positioned to improve the transfer of heat from the heat sink 50. The mat fins 62 have to direct the air in the proper direction whereas the pin fins 64 provide increased surface area to improve heat transfer performance. It is contemplated that the velocity of air flowing over the heat sink 50 may be double that experienced by conventional plate fins while also allow a weight reduction of about 30%. For example, testing conducted with the heat sink 50 of the present invention showed an increase in the average air velocity over the conventional heat sink 20 from 0.08 m/s to 0.17 m/s and a decrease in weight from 13.64 lbs. (for the conventional heat sink 20) to 9.32 lbs. (for the heat sink 50 of the present application). In this respect, the present invention may provide an increase in heat transfer efficiency with less material, as compared to conventional heat sinks.

It is contemplated that the aforementioned light system may be design for used in a variety of environments wherein efficient heat transfer is desired.

Although the invention has been described with respect to select embodiments, it shall be understood that the scope of the invention is not to be thereby limited, and that it instead shall embrace all modifications and alterations thereof coming within the spirit and scope of the appended claims.

What is claimed is:

1. A light device comprising:

a housing having at least one wall that defines an internal cavity; and a heat sink attached to the housing, the heat sink comprising:

a body, a plurality of mat fins disposed about a periphery of the body and defining a plurality of spaced-apart pathways extending from each side of the body toward a central portion of the body, and a plurality of pin fins disposed in staggered rows on the central portion of the body between opposite sides of the body, wherein the plurality of pin fins define a plurality of tortuous air paths along the central portion between opposite sides of the body and wherein air flowing in the plurality of spaced-apart pathways is directed by said plurality of mat fins into said plurality of tortuous air paths.

2. The light device of claim 1, wherein the heat sink is a cast body.

3. The light device of claim 2, wherein the heat sink is made of aluminum.

4. The light device of claim 1, wherein a recessed cavity is formed in a surface of the heat sink that is opposite to a face of the body whereon the plurality of pin fins is disposed.

5. The light device of claim 4, wherein the recessed cavity is contoured to receive electrical components.

6. The light device of claim 1, wherein the mat fins along one side of the body are disposed in parallel to other mat fins along said one side of the body.

7. The light device of claim 1, wherein the pin fins are disposed in staggered columns.

8. The light device of claim 1, wherein the mat fins are planar-in-shape.

9. The light device of claim 1, wherein the pin fins are cylindrical-in-shape.

10. The light device of claim 1, wherein the plurality of pin fins has an identical height.

11. The light device of claim 1, wherein the plurality of mat fins has an identical height.

12. The light device of claim 1, wherein an outer edge of at least one of the plurality of mat fins includes a curved portion and an angular portion.

13. The light device of claim 1, wherein the housing conforms to standards required for use in a hazardous environment.

* * * * *